US007789050B2

(12) United States Patent
Marchisseau

(10) Patent No.: US 7,789,050 B2
(45) Date of Patent: Sep. 7, 2010

(54) DEVICE AND METHOD FOR VARYING A COMPRESSION RATIO OF AN INTERNAL COMBUSTION ENGINE

(75) Inventor: Michel Alain Léon Marchisseau, Limoges (FR)

(73) Assignee: Institut Francais Du Petrole, Cedex (FR)

( * ) Notice: Subject to any disclaimer, the term of this patent is extended or adjusted under 35 U.S.C. 154(b) by 666 days.

(21) Appl. No.: 10/584,275

(22) PCT Filed: Dec. 21, 2003

(86) PCT No.: PCT/FR04/03329

§ 371 (c)(1),
(2), (4) Date: Jul. 11, 2007

(87) PCT Pub. No.: WO2005/071242

PCT Pub. Date: Aug. 4, 2005

(65) Prior Publication Data

US 2008/0022977 A1 Jan. 31, 2008

(30) Foreign Application Priority Data

Dec. 23, 2003 (FR) ..... 03 15214

(51) Int. Cl.
*F02B 75/04* (2006.01)

(52) U.S. Cl. ..... 123/48 B; 123/78 BA

(58) Field of Classification Search ..... 123/48 R, 123/48 B, 78 R, 78 B, 78 BA, 78 E, 78 F
See application file for complete search history.

(56) References Cited

U.S. PATENT DOCUMENTS 5,595,146 A * 1/1997 Bollig et al. ..... 123/48 B
2002/0050252 A1 * 5/2002 Moteki ..... 123/48 B

FOREIGN PATENT DOCUMENTS

JP 05171964 A * 7/1993

* cited by examiner

*Primary Examiner*—Noah Kamen
(74) *Attorney, Agent, or Firm*—Antonelli, Terry, Stout & Kraus, LLP.

(57) ABSTRACT

The invention relates to a device for varying a compression ratio in an internal combustion engine comprising at least one cylinder (10) provided with a combustion chamber (20), a movable element provided with a piston (14) which is translationally displaceable by means of a connecting rod (16) connectable thereto by an axis (24) and to the crank pin (34) of a crankshaft (36). The piston moves between a top dead center and a lower dead center allowing a dead volume (40, 118) at the top dead center of the piston. The invention also comprises a rotatable towed cam (42) which makes possible varying the compression ratio and means (32, 78*a*, 78*b*) for controlling the cam displacement. According to the invention, the control means comprises a fluid actuator (76) provided with a sliding block (54) arranged in a receiver (56) which is formed in a support (58) and limits two fluid chambers (75*a*, 75*b*) connected to at least one closed circuit (77; 78*a*, 78*b*).

14 Claims, 6 Drawing Sheets

DEVICE AND METHOD FOR VARYING A COMPRESSION RATIO OF AN INTERNAL COMBUSTION ENGINE

BACKGROUND OF THE INVENTION

1. Field of the Invention

The present invention relates to a device for varying the compression ratio of an internal combustion engine and a method for using such a device and in particular relates to a device that can change the compression ratio of this engine by modifying the dead volume of the combustion chamber at the piston top dead center.

2. Description of the Prior Art

EP Patent 0,297,904 discloses a device for varying the compression ratio of an engine wherein the engine includes a crankshaft, a cylinder in which a piston slides in an alternating translational movement by means of a connecting rod connected to the piston and to the crankshaft. The piston defines with the top of the cylinder a combustion chamber including a dead volume at the top dead center (TDC). A rotary eccentric, of the pull type, is disposed between the connecting rod and the piston. The eccentric, in a first position, enables the piston to reduce the dead volume of the combustion chamber while increasing the compression ratio and increases this dead volume in the second position to achieve a lower compression ratio. The eccentric has a groove which cooperates with two locking pins each disposed symmetrically relative to the piston axis enabling the eccentric to be immobilized in one or other of the two positions.

This device, although satisfactory, nonetheless has a number of drawbacks.

One of the drawbacks of such a device resides essentially in the lack of flexibility in the options for adjusting the compression ratio, with only two options for varying the ratio.

Moreover, such a device requires a precise fit between the groove and the pin to prevent any locking of the pin in the groove.

In another type of device for varying the compression ratio, described in German Patent DE-A-42 26 361, the eccentric (which is not a pull type eccentric) is an eccentric driven by the cooperation of a toothed sector of the eccentric with an endless screw.

This device has a major drawback in that the endless screw must be driven to control the rotation of this eccentric. This drive takes up a great deal of space and requires high power levels to overcome the inertia of the moving parts and the various frictions.

SUMMARY OF THE INVENTION

The present invention overcomes the above drawbacks of the prior art by providing a device for varying the compression ratio that is simple in design, takes up little space, and increases the options for varying the compression ratio.

The present invention relates to a device for varying the compression ratio of an internal combustion engine having at least one cylinder with a combustion chamber, moving parts comprising a piston translationally movable under the action of a connecting rod that is connected by a shaft to the piston and is connected to a crankpin of a crankshaft. The piston travels between a top dead center and a bottom dead center leaving a dead volume at the top dead center of the piston. The device having a rotary pull type eccentric for varying the compression ratio and means for controlling the movement of the eccentric is utilized wherein characterized a control including a hydraulic cylinder comprising a slide placed in a recess formed in a support and defining two fluid chambers in communication with at least one closed circuit.

The fluid chambers can be in communication with each other via at least one closed circuit.

The closed circuit can include at least one valve means for controlling the flowrate of fluid from one chamber to the other.

Advantageously, the valve means can be at least a two-way valve.

Preferably, the valve means can be a piezoelectric device.

The piezoelectric device can include a needle valve and a piezoelectric actuator.

The piezoelectric device can be controlled by cooperation of contacts and electrical segments.

The circuit can include at least one metering device located downstream of the valve means.

The metering device can include a piston-cylinder assembly with a calibrating spring.

The elements of the closed circuit can be at least partly accommodated in a hydraulic cylinder.

A varying device can include means for pinpointing the position of the eccentric.

The pinpointing means can comprise a signal transmitter-receiver assembly.

The eccentric, which can include the transmitter and the receiver, can be accommodated in a fixed part of the engine.

The eccentric can include means for shape cooperation with the slide.

The cooperation means can include a toothed sector mounted on the eccentric and a toothed rack mounted on the slide.

The invention also relates to a method for varying the compression ratio of an internal combustion engine, wherein the engine includes at least one cylinder with a combustion chamber, moving parts comprising a piston translationally movable under the action of a connecting rod that is connected by a shaft to the piston and connected to a crankpin of a crankshaft, the piston travelling between a top dead center and a bottom dead center to provide a dead volume at the top dead center of the piston, comprising the method of:

determining the desired compression ratio of the engine;

determining an extent of displacement of a rotary pull type eccentric to obtain the desired compression ratio;

controlling the rotation of the eccentric to obtain the determined displacement by controlling a hydraulic cylinder to command the displacement of the eccentric.

One advantage of the present invention over the prior art devices is that the energy loss of a bearing between the connecting rod and the crankpin of the crankshaft is less. Indeed, when the compression ratio does not vary, the position of the eccentric relative to the connecting rod is fixed and the bearing between the connecting rod and the crankpin is accomplished by the relative displacement between the eccentric and the crankpin. Hence, the bearing between the connecting rod and the crankshaft is accomplished with a smaller bearing diameter, which is a non-trivial advantage since, as is known, the energy loss of a bearing, for a given load under normal operating conditions, increases as a function of its diameter.

Another advantage of the present invention is easier control of compression ratio adjustment. The present invention uses a reversible kinematic link that continuously connects the range of motion of the eccentric to translation of the slide. Hence, the angular lead of the eccentric, and hence the compression rate adjustment, is a continuous function of the translational position of the slide defined by the mechanical design of the device according to the invention. Hence, at no time can the compression ratio vary without the translational position of the slide being modified and, because of the hydraulic device of the present invention, positional control of the slide is easily achieved.

Other additional advantages of the present invention are lower energy loss, greater precision, and longer lifetime. The present invention uses a reversible kinematic link that continuously connects the range of motion of the eccentric to translation of the slide. Because of the reversibility of the kinematic link, the friction in this link can be minimized by the design. Hence, the energy loss through friction in the link, the wear in the link, and the degree of hysteresis can all be less. Moreover, the reduction in hysteresis leads to better accuracy in adjusting the compression ratio. Furthermore, due to its reversibility, the kinematic link of the present invention has no risk of jamming. This reversibility can be achieved due to a toothed segment, preferably placed in the peripheral wall of the eccentric, which, through an opening in the connecting rod head, cooperates with a toothed rack, of the rack and pinion type, provided in a slide that moves in a recess in a support connected to the connecting rod head. This slide moves tangentially to the circumference of the eccentric.

Yet another advantage of the present invention resides in the greater simplicity of integrating the device into the engine and into its environment. The present invention uses an eccentric accommodated between the crankpin and the bore of the connecting rod head. Hence, the distance between the crankshaft axis and the various peripherals of the engine—camshaft, starter, alternator, water pump, etc.—does not vary and hence does not lead to additional specific devices to offset the variations in distance between the crankshaft and the engine peripherals. Likewise, the alignment between the crankshaft and the transmission does not change. Because of the present invention, it is not necessary to use specific device to offset changes in alignment between the engine and the transmission to which it is coupled.

Moreover, the device according to the invention leads to lower weight and a smaller space requirement and greater reactivity in adjusting the compression ratio. Because the eccentric is pulled, adjustment of the compression ratio requires no eccentric drive motor and the device is hence not encumbered by the weight, space requirement, and response times of a specific motor and its kinematic links to drive the eccentric rotationally in order to adjust the compression ratio.

Moreover, the invention has still other advantages such as compatibility with a shorter distance between the crankshaft axis and the engine cylinder head, less vibration, and less construction cost. The hydraulic piston, whose function is to control the position of the eccentric located between the connecting rod head and the crankpin, is distinct from the eccentric; in particular, its slide is distinct from all the other parts and can move independently of all these other parts. Because of this, a wide choice in the orientation of the piston with respect to the connecting rod is possible, which simultaneously optimizes the distance between the crankshaft axis and the cylinder head as well as vibrations brought about by the moving parts and also the shapes to reduce manufacturing costs.

BRIEF DESCRIPTION OF THE DRAWINGS

The other features and advantages of the invention will appear from reading the description hereinbelow, provided solely for illustration and non-limiting, to which are attached:

FIG. 6*a* shows another detailed view of the invention showing one variant of the elements of the control circuit of the invention, while

DETAILED DESCRIPTION OF THE INVENTION

Figure 1:
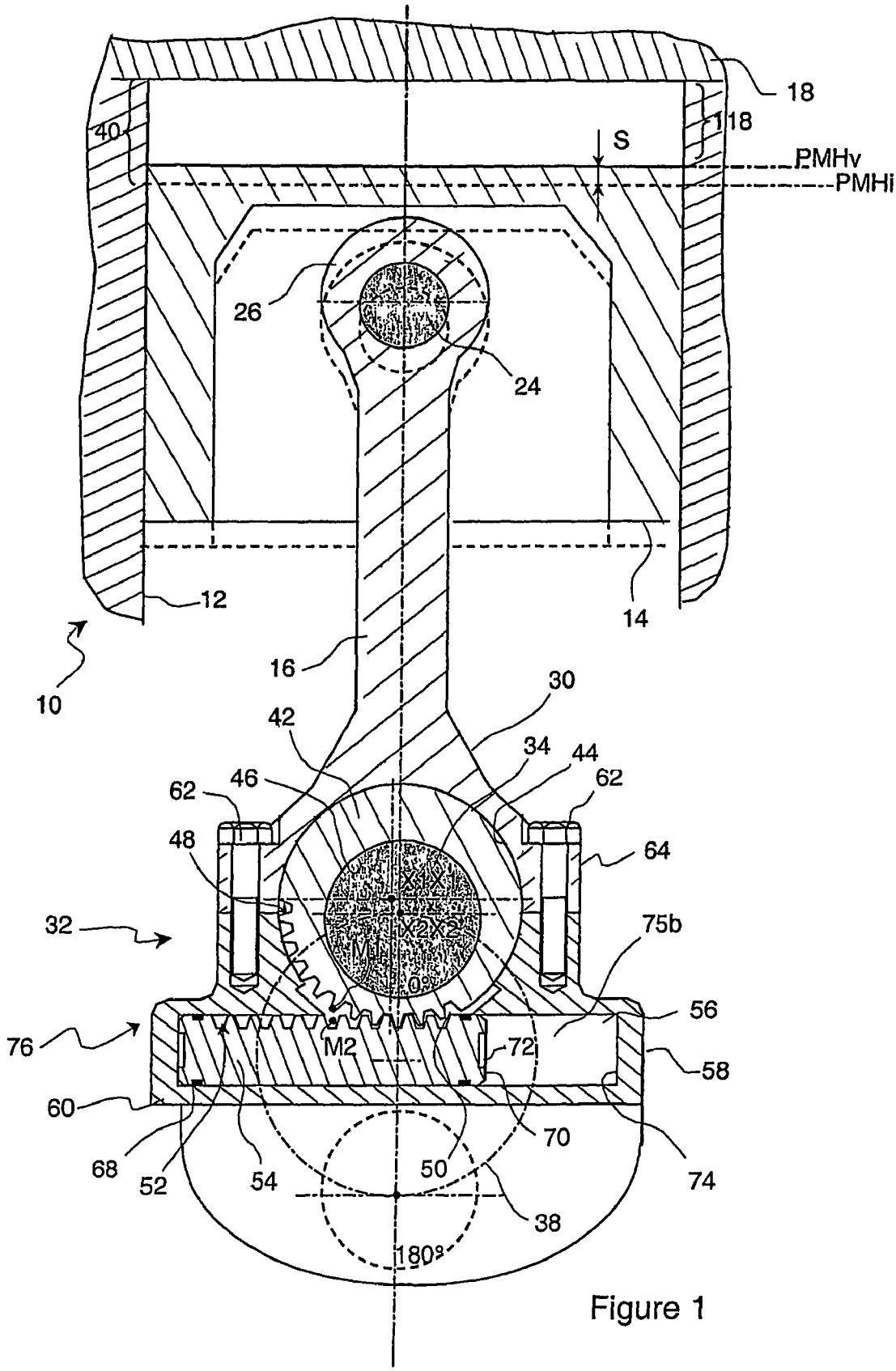
FIG. 1 shows, in axial section, an internal combustion engine with the invention for varying the compression ratio in a first position.
Figure 2:
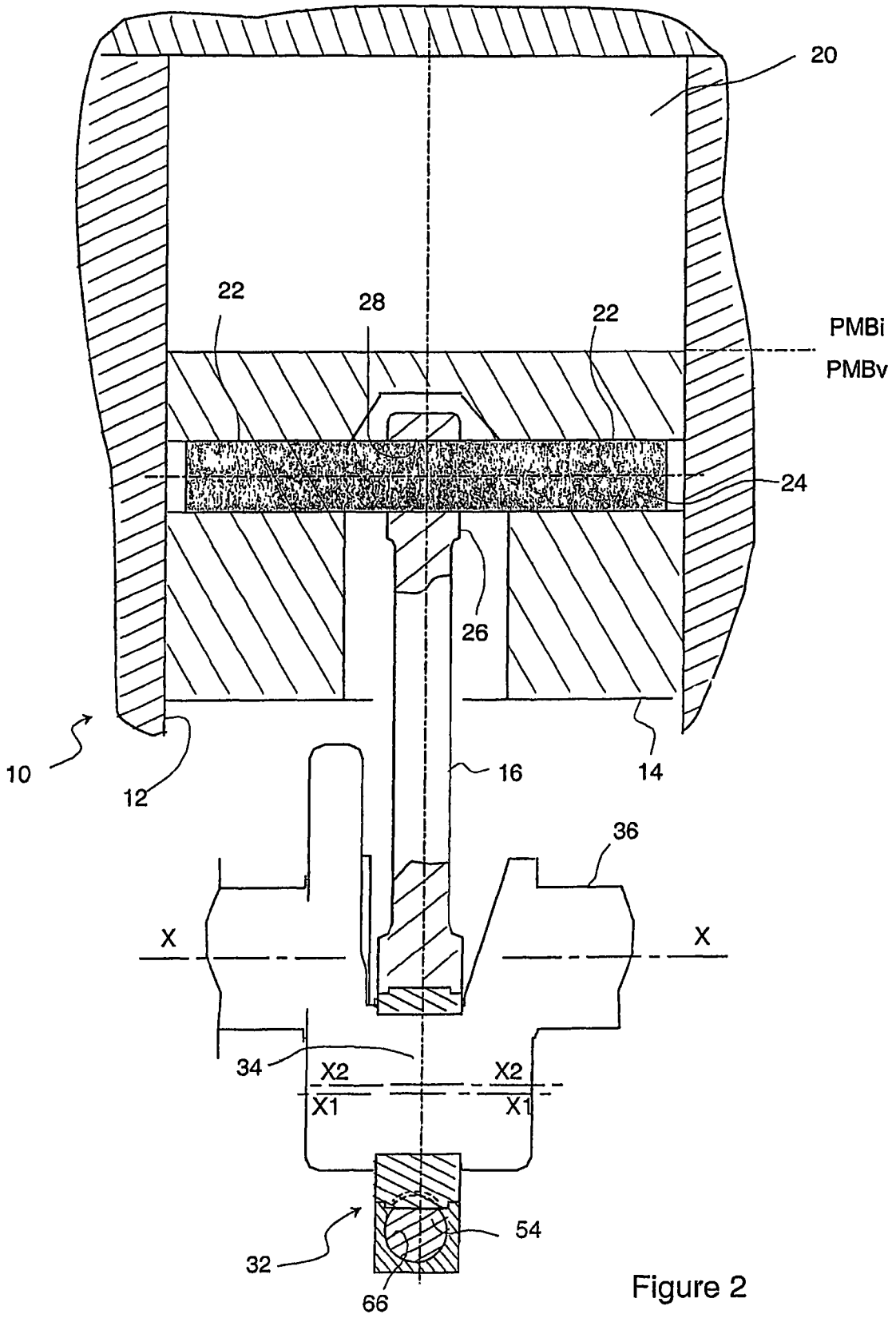
FIG. 2 shows in axial section, another view of the internal combustion engine with the invention of FIG. 1 in another position and in another configuration.
Figure 3:
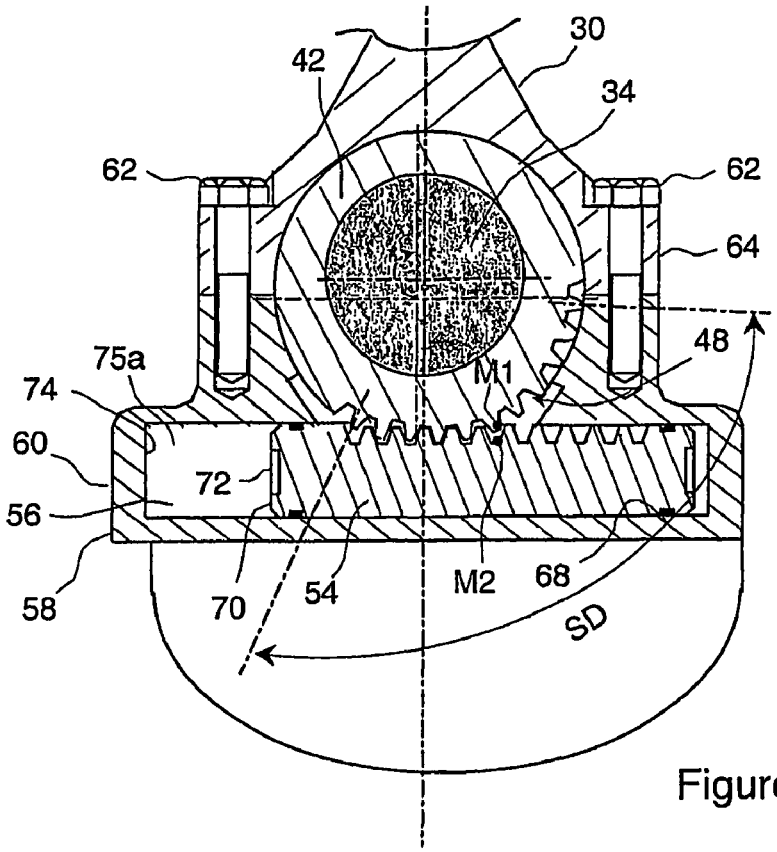
FIG. 3 shows a detailed view in an end position of the invention in FIG. 1.

Reference will now be made to FIGS. 1 to 3 which show an internal combustion engine with at least one cylinder 10 that includes a bore 12 inside which slides a hollow piston 14 in an alternating translational movement driven by a connecting rod 16. This piston, at its top part, limits the side wall of the bore 12. At the top part of this bore, which is formed by part of the cylinder head 18, the combustion cycle takes place in a combustion chamber. The piston has two diametrically opposed radial bores 22 through which passes a cylinder shaft 24 which connects one end 26 of the connecting rod, known as the connecting rod foot, to the piston, which slides through a bore 28 provided in the connecting rod foot. The other end 30 of the connecting rod, which is the connecting rod head, is connected by a device for varying the compression ratio 32 to a crankpin 34 of a crankshaft 36. This crankshaft is subjected to a rotary movement about an axis XX such that the crankpin 34 describes a circular path 38 around axis XX. As is known, piston 14, connecting shaft 24, connecting rod 16, and crankshaft 36 with its crankpin 34 form the moving parts of the engine.

In conventional engines, during the rotary movement of the crankshaft 36 such as the intake and expansion phases, crankpin 34 passes successively into a top position, indicated as 0° in FIG. 1, to a bottom position, indicated 180°. During this movement, piston 14, which is connected to crankpin 34 by connecting rod 16, undergoes an alternating translational movement between an initial top dead center (marked TDCi in FIG. 1) which corresponds to the top position of the crankpin and an initial bottom dead center (marked BDCi) in FIG. 2) corresponding to the bottom position of the crankpin. Thus, piston 14 has an initial travel between its TDCi and its BDCi.

In these engines, when the piston is at the TDCi, either at the end of the compression phase or at the end of the exhaust phase, a dead volume remains in combustion chamber 20. This volume is necessary for operation of the engine during its compression, combustion, and exhaust phases.

As a person skilled in the art is aware, the compression ratio of an engine is a function not only of the size of the cylinder volume defined by the piston stroke but also the size of the dead volume. To modify the compression ratio, it is needed to only modify one of these volumes, particularly the size of the dead volume.

To achieve this, the device for varying the compression ratio 32 has an eccentric 42 located between crankpin 34 and bore 44 provided in the connecting rod head 30. This eccentric has a generally circular shape with a geometric axis X1X1 that corresponds to its center axis and has a bore 46 with an axis X2X2 that is non-coaxial with axis X1X1 but is equated with the axis of crankpin 34. This eccentric is slidably positioned in the reception bore 44 provided in the connecting rod head and in the peripheral wall of crankpin 34.

This eccentric is described as "pulled" because, when the engine is operating, it can be driven rotationally about axis X2X2 in response to a rotational torque generated by the inertia resulting from movement of the moving parts, particularly the piston and the cylinder.

In fact, crankpin 32 travels along a semi-circular path for one phase, for example the intake phase, from 0° to 180°, then another semi-circular path (from 180° to 0°) for another phase, such as the compression phase. During these movements, the piston 14 goes from its top dead center to its bottom dead center and then from its bottom dead center to its top dead center. During this movement, the piston and connecting rod 16 undergo acceleration which increases with decreasing distance to one of its dead centers. When the inertia force resulting from this acceleration, is sufficient to overcome not only the weight of piston 14 and of connecting rod 16 and/or the resultant force of the gas pressures on the piston and connecting rod but also the frictional forces between this piston and the wall of the cylinder bore, an increase in speed is generated of the piston-connecting-rod assembly relative to the speed transmitted to the assembly by the crankpin. Hence, if the range of motion of the eccentric is not impeded, there is additional movement of the piston and connecting rod relative to that brought about by the crankpin. This movement takes place upward when the piston is on the top dead center side and downward when this piston is on the bottom dead center side. This additional drive can be made possible by rotation, around axis X2X2, of the eccentric 42 connected to connecting rod 16. As shown for example in FIGS. 1 to 3, the eccentric has a rotational counterclockwise movement with a decrease in the compression ratio when the piston is traveling from its top dead center to its bottom dead center and a clockwise movement for an increase in the compression ratio when the piston is passing from its bottom dead center to its top dead center.

The eccentric has, preferably on its peripheral wall, a toothed sector 48, with an angular sweep SD, which, through an opening 50 provided in connecting rod head 30, cooperates with a toothed rack 52, of the rack and pinion type, provided on a slide 54 movable in straight-line translation in a recess 56 in a support 58 connected to connecting rod head 30. Preferably, this support is built into the lower semi-bearing 60 that the connecting rod head 30 normally has and which is attached by screws 62 to the other semi-bearing 64 on the connecting rod body. Slide 54 has a peripheral wall 66 with a cylindrical section on which are placed seals 68 in the vicinity of its terminal faces 70 which preferably have axial recesses 72. The peripheral wall is interrupted by rack and pinion 52 which is substantially rectilinear and which extends over a major part of the length of this slide. The rack and pinion has a length that corresponds at least to the length of toothed sector 48 of eccentric 42. Recess 56 matches in shape the cross section of slide 54 and has two end walls 74. The distance between these two walls and the pitch of the toothed sector of the eccentric relative to the toothed rack of the slide are such that the total length of the slide, to which is added the total range of motion of this slide, under the effect of the eccentric rotating, enables the geometric axis X1X1 of the slide to be located to the left of the cylinder shaft, as seen in the drawings, both at the top dead center and at the bottom dead center of the piston. Preferably, the angular range of motion of the eccentric is approximately 120° C. between its two end positions. To establish the initial pitch of the toothed sector when the device is assembled, the center point M1 of the eccentric toothed sector is located half-way to point M2 along the length of the rack and pinion so that the axis X1X1 of the eccentric is at the same height as axis X2X2 of the crankpin at the top dead center and the bottom dead center of the piston. Thus, from the nominal position, the eccentric rotates counterclockwise through an angle of approximately 60° to obtain a minimum compression ratio that can be the nominal ratio and, reaching the position in FIG. 3 and for a maximum ratio, rotates, still from this initial pitch position, through an angle of approximately 60° clockwise to arrive at the position in FIG. 1. When the maximum ratio is reached, the eccentric rotates in the counterclockwise direction through an angle of approximately 120° to reach the minimum ratio and through about 120° clockwise to obtain a maximum ratio from its minimum ratio. The space defined by the peripheral wall of the recess, its end walls, and the end faces of the slide thus form two sealed fluid chambers, called 75*a* and 85*b*, that allow and control the movement of the slide in the recess. This forms a hydraulic cylinder 76 comprising support 58 with its recess 56 in which slide 54 moves in a straight-line motion under the effect of the fluid present in chambers 75*a*, 75*b*. Thus, the variation device has a slide and a slide support that are separate from the eccentric. The relative translational position of the slide, relative to its support, is in a continuous kinematic link with the angular range of motion of the eccentric relative to the connecting rod by a kinematically reversible link.

Figure 4:
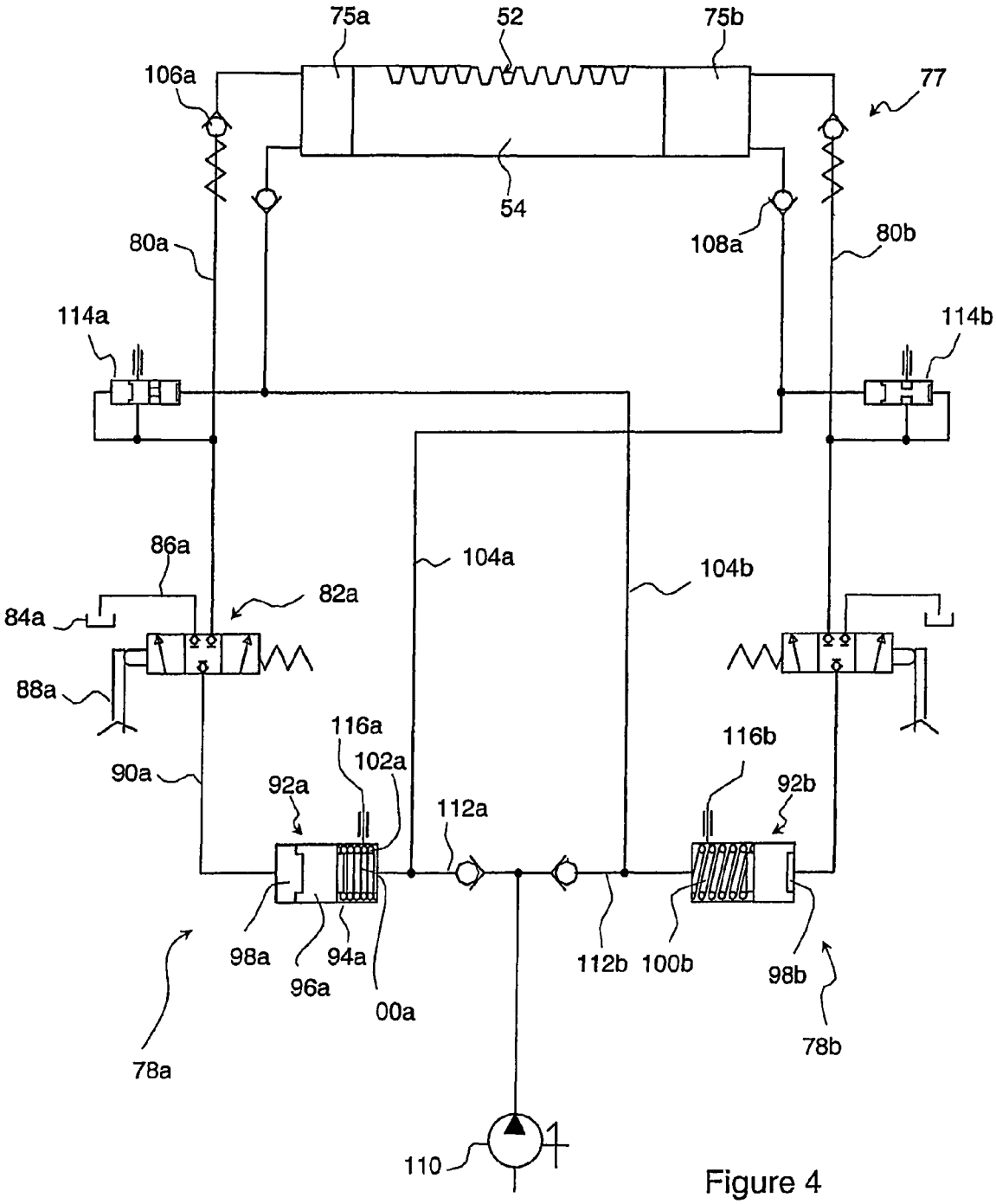
FIG. 4 shows a schematic drawing of the control circuit used for the device according to the invention.

This recess is connected to a control circuit 77, as shown in FIG. 4, which controls the rotation of the eccentric by controlling the movement of the slide.

The control circuit includes at least one closed circuit in which a fluid, oil for example, circulates. In the example of FIG. 4, the control circuit has two closed circuits 78*a* and 78*b* and each circuit connects the two chambers 75*a* and 75*b*. Chamber 75*a* is connected by a line 80*a* to a valve means 82*a* and specifically to a three-way valve having one outlet connected to line 80*a* and the other of the ways is connected to a tank 84*a* by a line 86*a*. The valve is controlled by a means 88*a* whose activation depends on the demand for varying the compression ratio. A line 90*a* then connects the outlet of valve 82*a* to a metering device 92*a* comprising a cylinder 94*a* with a sealed piston 96*a*, movable inside this cylinder, which defines two metering chambers 98*a* and 100*a*. Chamber 98*a* is connected to line 90*a* while chamber 100*a*, which has a spring 102*a*, is connected by a line 104*a* to fluid chamber 75*b*. Advantageously, lines 80*a* and 104*a* have non-return valves 106*a* and 108*a* preventing fluid from flowing back into chamber 75*a* and from flowing out of chamber 75*b*, respectively.

Additionally, the control circuit has means for filling and draining circuits 78*a* and 78*b*. These means include a hydraulic pump 110, lines 112*a*, 112*b* each having a non-return valve and connected to lines 104*a*, 104*b*, drain valves 114*a* and 114*b* connected to lines 80*a* and 80*b*, and drain devices 116*a* and 116*b* located on metering devices 92*a* and 92*b*.

Thus, considering FIG. 4, the leftward movement of slide 54 is controlled by the opening of valve 82*a* which, via lines 80*a* and 90*a*, places fluid chamber 75*a* in communication with metering chamber 98*a*. Under the effect of the pressure generated in fluid chamber 75*a* by the movement of the slide driven by the eccentric, piston 96*a* is urged against spring 102*a* in the direction of metering chamber 100*a* and the fluid present in this chamber is introduced via line 104*a* into fluid chamber 75*b*. Thus, any reduction in the volume of one fluid chamber results in an increase in the volume of the other chamber. This spring is calibrated such that it gradually introduces fluid into chamber 98*a*, preventing the slide from jerking. As soon as this slide reaches the desired position, valve 82*a* is made to close by control 88*a* to keep the slide in the position it has reached. When this action takes place, the communication between chambers 75*a* and 98*a* is closed, and evacuation of the fluid present in metering chamber 98*a*, urged by spring 102*a*, is allowed through lines 90*a* and 86*a* to tank 84*a*.

The volume of the metering chamber 98*a* is designed to correspond to a given displacement value of the slide, hereinafter called "increment," and this increment can be used partially or fully when this slide moves. To adjust the compression ratio to the desired value, the volume of fluid coming from fluid chamber 75*a*, when the slide moves, can be greater than this increment. In this case, the control 88*a* brings about several opening and closing sequences of valve 82*a* to sequentially fill and drain chamber 98*a*, keeping the slide in the position reached then causing this valve to close as soon as the eccentric reaches the desired position.

Movement of slide 54 in the opposite direction, that is rightward, is controlled in the same way, but acting on the various elements of closed circuit 87*b*.

Thus, to impose a clockwise or counterclockwise direction of movement on the eccentric, one or the other of the circuits will be operated.

Regarding the filling and draining of circuits 78*a*, 78*b*, hydraulic pump 110 fills, through lines 112*a*, 112*b*, the metering chambers 100*a*, 100*b* and lines 104*a*, 104*b*. Through these lines, fluid chambers 75*a*, 75*b* are also filled, as are lines 80*a*, 80*b*, by means of which metering chambers 98*a*, 98*b* are also filled. During this filling procedure, the drain valves 114*a*, 114*b* as well as drains 116*a*, 116*b* are opened to evacuate any air present in the circuits. Of course, as is usual, the pump and lines 112*a*, 112*b* will be used to make up for any fluid losses while the device is operating.

Figure 5:
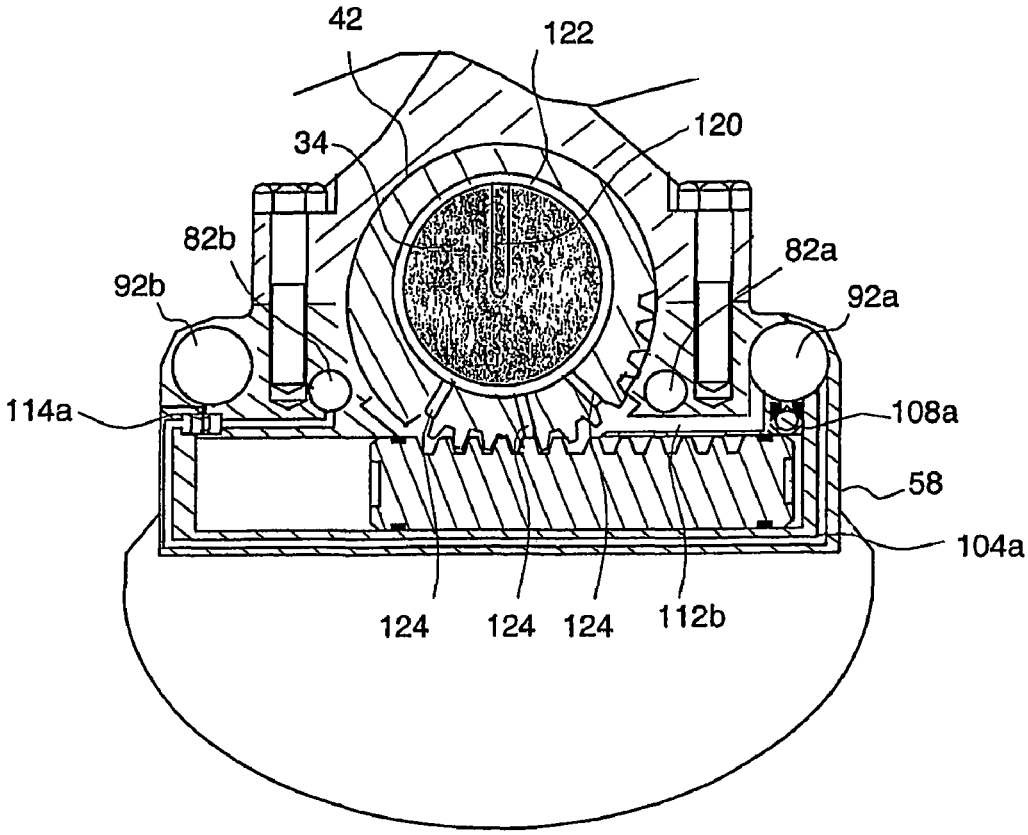
FIG. 5 shows a detailed view of the invention showing the elements of the control circuit of the invention.

In practice, as can be seen more clearly in FIG. 5, the various lines, metering devices, drain valves, drains, and non-return valves are accommodated in support 58.

Since these various elements are placed in several parallel planes transversal to the crankshaft axis, only some of these elements have been shown, to keep the drawing simple. It can thus be seen that the introduction of fluid for filling the circuits is done through axial and radial bores 120 in the crankshaft and crankpin, via a circumferential groove 122, between the bore of the eccentric 42 and the peripheral wall of crankpin 34, for communication with bores 120, and via radial bores 124 providing the communication between groove 122 and line 112 (or line 112*b*) provided in support 58. This support also has control valves 82*a* and 82*b*, metering devices 92*a* and 92*b*, non-return valves 106 and 108 (or 108*a*), drain valves 114 (or 114*a*), and lines 80, 90, 104 (or 104*a*) providing communication between these elements.

In operation, the device that varies the compression ratio is in a given configuration, as shown in FIG. 3, which corresponds, for example, to a minimum compression ratio, which can be the nominal ratio, and piston 14 is at its bottom dead center (BDCv) as illustrated in FIG. 2. In this configuration, the BDCi is the same as the BDCv and piston 14 travels from this bottom dead center to its top dead center to accomplish the compression phase of the air or air-fuel mixture present in the combustion chamber, as shown in FIG. 1. During this travel, as illustrated in FIGS. 1 to 3, crankpin 34 travels on a semi-circular path from its bottom point) (180°) to its top point (0°). During this movement, the piston 14, connecting rod 16, and eccentric 42 first undergo maximum acceleration to the bottom dead center which decreases when the piston and connecting rod move, then goes to zero. The piston and this connecting rod then undergo a deceleration which increases as piston 14 approaches its top dead center. When the resultant force of this deceleration is sufficient to overcome the resultant force of the gas pressures applied to the piston, the weight of piston 14 and of connecting rod 16, and the various frictional forces, driving of the piston and the connecting rod is generated by this inertial force in an upward movement (as seen in the drawings). This movement is accomplished all the more easily in that the inertial and frictional forces and the resultant force of the gas pressures are all directed upward. These conjugated forces are applied to axis X1X1 and create a torque which tends to rotate the eccentric around axis X2X2 clockwise in the slide position illustrated in FIG. 3.

Thus, depending on the engine operating parameters such as engine load and speed, a compression ratio is determined to respond to the demand. This compression ratio is determined by a control unit, for example the computer that the engine normally has, and this computer determines a range of motion angle for the eccentric to achieve this ratio. With reference once more to FIG. 4, in the case the compression ratio is increased, control instructions are sent by the computer to control 88*a* of three-way valve 82*a* to place in communication, during a number of sequences corresponding to an increment number and/or part of an increment of slide movement, and a duration determined by the computer, the fluid chamber 75*a* with the metering device 92*a* to allow movement of the slide by transfer of fluid from one fluid chamber 75*a* to the other fluid chamber 75*b* via this metering device. Under the effect of rotation by the eccentric and cooperation of the toothed sector 48 of the eccentric with the rack and pinion 52 of the slide, this slide moves leftward to increase the compression ratio. Thus, by precisely and continuously controlling the amount of fluid leaving the fluid chamber by causing the valve to open and close, it is possible to control the movement of the slide so that the eccentric moves rotationally according to the angular range of motion determined by the computer. At the end of the activation of valve 82*a* and the time for which this valve is open, the latter remains closed, isolating chamber 75*a* from chamber 75*b*, and the slide is immobilized in position by means of the fluid isolated in these chambers. In this configuration, the eccentric has traveled for the angular range of motion determined by the computer. Upon closure of valve 82*a*, the fluid present in chamber 98*a* of the metering device 92*a* is evacuated to tank 84*a* by lines 90*a*, 86*a* and piston 96*a* of this metering device is back in the original state, that is close to line 90*a*.

Under the influence of this angular range of motion, clockwise according to FIG. 3, piston 14 performs an overtravel S relative to its TDCi and arrives at the position illustrated in FIG. 1. In this position, the center to center distance between the shaft 24 of piston 14 and the shaft of the crankpin has increased, and piston 14 has prolonged its initial travel by passing beyond the TDCi and penetrating into the initial dead volume 40. In this position, this initial dead volume is decreased and a new dead volume 118 is created in cylinder 12. Since this new dead volume is smaller than the initial dead volume, the compression ratio of the engine is increased.

This configuration of the device is retained for as long as this modified ratio is desired.

Since the rotation of the eccentric is continuously controlled by means of controlled movement of the slide by circuits 78*a* and 78*b*, it is possible to vary the value of overtravel S from TDCi to TDCv, and hence the magnitude of the dead volume.

Thus, because of controlled movement of the slide, which movement is a function of the response time and number of openings and closings of valve 82*a*, it is possible to increase this displacement and obtain a multitude of compression ratio options by a plurality of angular positions of the eccentric.

As soon as the computer determines a new angular range of motion of the eccentric which, for the example described below, corresponds to a new compression ratio lower than that reached (and this new ratio can be the initial compression ratio for which the initial dead volume is found or a ratio lower than that obtained in a previous phase of increasing this ratio), the computer sends instructions to control 88*b* of valve 82*b* of circuit 78*b* so that the eccentric 42 is in the position illustrated in FIG. 3 or in a position close to that of this drawing to decrease the compression ratio obtained in a prior phase.

To accomplish this, an operating phase of the engine during which crankpin 34 passes from its 0° position to 180°, is used as the intake or expansion phase.

During this phase, the forces described above are applied to the crankpin but in the opposite direction. This has the effect of applying a force to axis X1X1 that tends to rotate the eccentric around axis X2X2 counterclockwise.

To allow this rotation of the eccentric one need only allow controlled movement of the slide in its recess. To do this, with reference to FIG. 4, the opening/closing command for a specific duration of three-way valve 82*b* allows the fluid chamber 75 b to be placed in communication with the metering device 92*b* so as to allow this slide movement, while controlling the transfer of the amounts of fluid dispensed by metering device 92*b* from one fluid chamber 75*b* to the other fluid chamber 75*a*. Under the effect of rotation of the eccentric generated by the inertial force and cooperation of toothed sector 48 of the eccentric with the toothed rack 52 of the slide, the slide moves rightward to arrive at the position illustrated in FIG. 3.

Also, this movement of the slide is continuously controlled by acting on valve 82*b*, allowing a plurality of angular positions of the eccentric to be obtained during its counterclockwise movement and hence a plurality of options for decreasing the overtravel of the piston, which has the effect of obtaining a plurality of options for increasing the dead volume 118 up to the initial dead volume 40.

Thus, because of this compression ratio varying device, it is possible not only to obtain a plurality of options for increasing the compression ratio but also a plurality of options for decreasing this ratio from a ratio that has undergone an increase.

Figure 6A:
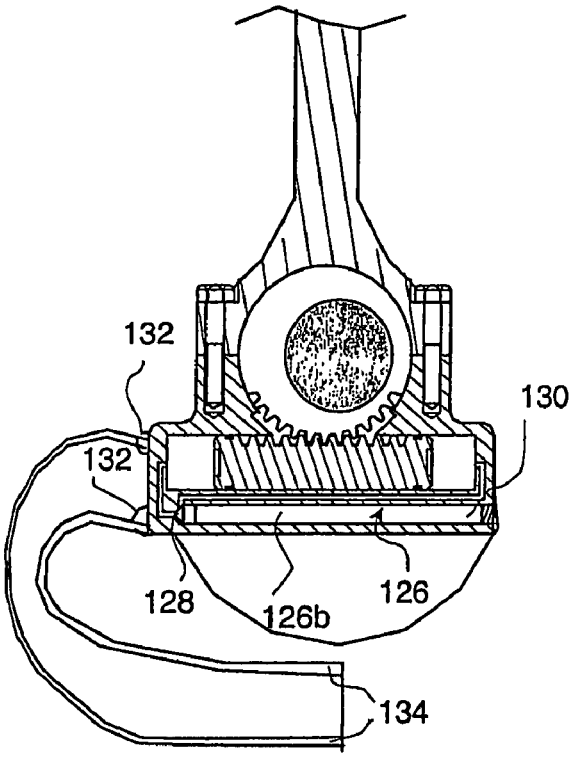
Figure 6B:
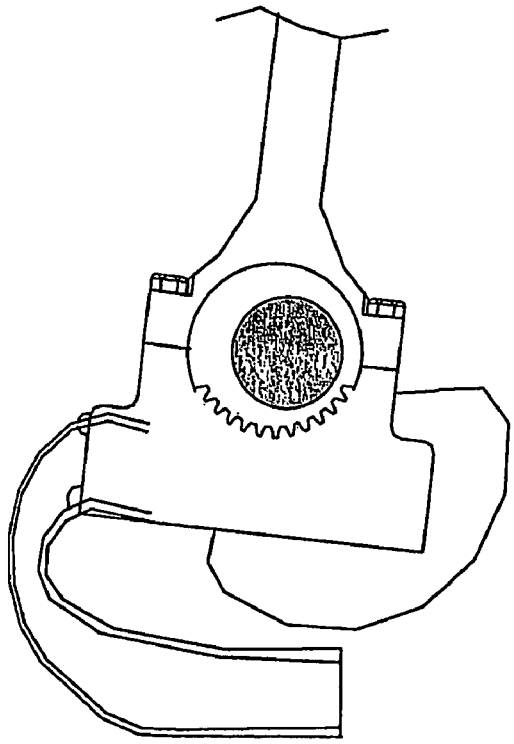
FIGS. 6*b* to 6*d* illustrate the various positions of the invention during the rotation of the crankshaft.
Figure 6C:
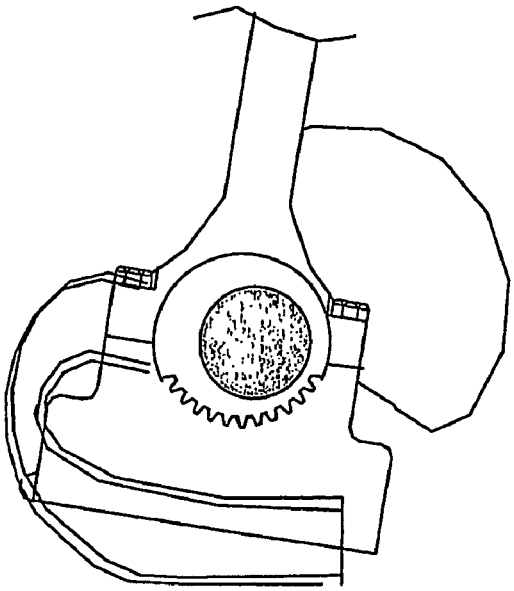
Figure 6D:
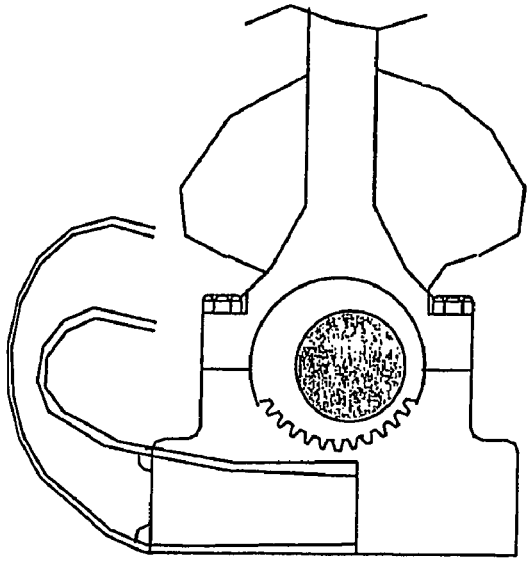

Reference will now be made to FIG. 6*a* which shows an alternative embodiment of the invention.

This embodiment differs from the embodiment described above only by the fact that each three-way valve is replaced by two piezoelectric devices 126 (or 126*b*) that enable the response time to be increased and consequently the compression ratio adjustment accuracy to be enhanced. Each of the devices has a needle valve 128 subjected to the action of a piezoelectric activator 130 and constitutes a two-way valve. One of these piezoelectric devices controls the passage of fluid between line 80 (or 80*b*) and line 90 (or 90*b*) and the other of the piezoelectric devices controls the passage of fluid between line 90 (or 90*b*) and line 86. Thus, each three-way valve 82*a*, 82*b* of the circuit shown in FIG. 4 is replaced by two two-way valves each formed by a piezoelectric device.

To control the piezoelectric actuator which acts on the range of motion of the needle valve, support 58 has two electrical contacts 132 connected by electrical conductors (not shown) to this actuator. Electrical segments 134 are mounted on a fixed element of the engine, such as the engine crankcase, and are disposed such that they are continuously opposite contacts 132 at least for one movement of the crankpin from its 0° point to its 180° point as illustrated in FIGS. 6*a* to 6*d*. Of course, and without departing from the framework of the invention, these segments can extend over the entire 360° rotation of the crankpin. These segments pass an electric current creating a magnetic field which creates an electric current in contacts 132 to actuate them. Advantageously, one electrical segment 134 is assigned to control each of the piezoelectric devices and a fifth segment controls the four piezoelectric actuators 130 in common.

The operation of the compression ratio varying device 32 and circuits 78*a*, 78*b* is the same as that described in relation to FIGS. 1 to 5 with the following differences: the fluid passage link between fluid chamber 75*a*, 75*b* and metering chamber 98*a*, 98*b* is provided by a first two-way valve composed of a piezoelectric device, the fluid passage link between the metering chamber 98*a*, 98*b* and tank 84*a*, 84*b* is provided by another two-way valve comprised of a piezoelectric device, and an electrical current is sent to segments 134 to control the opening of the needle valve 128 in response to a demand to vary the compression ratio.

The embodiments of the control of the variation device described thus far call for the use of two closed circuits to control the movement of the slide. However, it is also possible to use just one circuit with a line to provide a communication between chamber 75*a* and a valve means such as a three-way valve, which would in this case be replaced by a two-way valve or the piezoelectric device described above, and a line connecting the valve means with the other fluid chamber 75*b*. Of course, the filling means with their hydraulic pump and the lines connecting it with the line connecting the valve means to chamber 75*b*, as well as the drain valves, can also be provided in this single circuit.

So that the engine compression ratio is known at all times, a means for pinpointing the angular location of the eccentric 42 is provided, as illustrated in FIGS. 7*a* to 7*d*.

This means includes a signal transmitter-receiver 136 with one of the elements mounted on the eccentric 42 and the other of the elements mounted on a fixed element of the engine, so that a leg 138 emerges from one wall of the crankcase. Advantageously, the eccentric has an indicator 140 which emits a signal by radiation, for example by magnetic radiation, and leg 138 carries a receiver formed by a reader 142 of the signal emitted by indicator 140 reporting the position of this indicator during the rotation of crankpin 34. This reader is substantially arcuate with its concave side pointing toward the crankshaft, with an essentially constant radial thickness E. This reader has a first reading area 144 located at its top part to read the signal emitted by the indicator 140 when the compression ratio is at a maximum or is increased and a second area 146 in the bottom part of this reader to read the signal emitted by indicator 140 when the compression ratio is nominal or decreased.

Figure 7A:
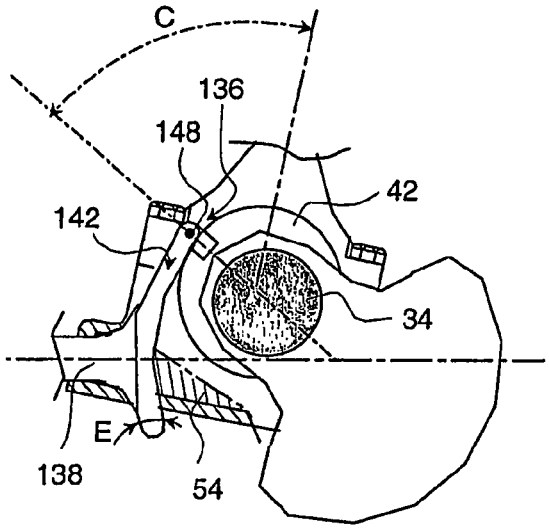
FIGS. 7*a* to 7*d* show another illustration of the invention for locating the angular position of one of the elements of the device for varying the compression ratio according to the invention.
Figure 7B:
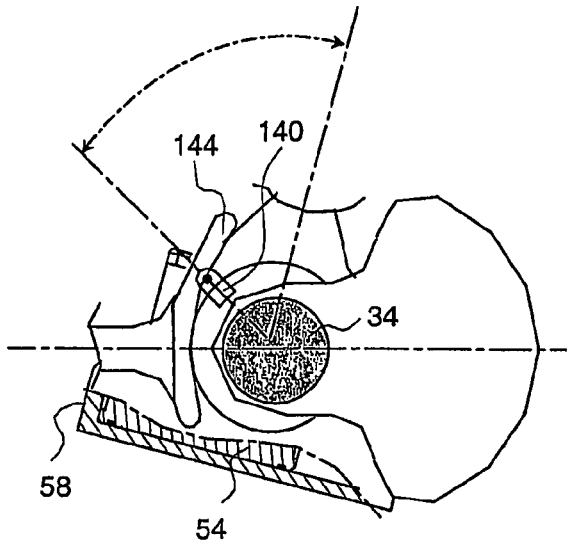
Figure 7C:
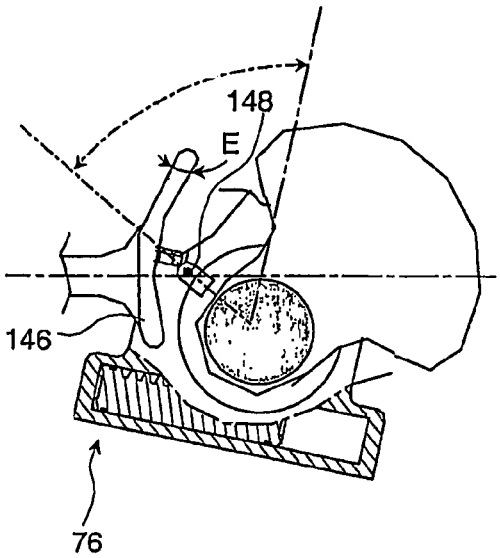
Figure 7D:
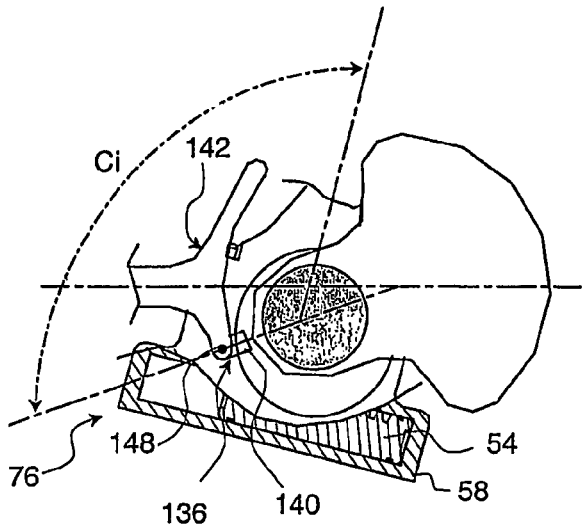

During operation of the engine, the engine computer determines the angular lead C of the eccentric relative to the lengthwise axis of the connecting rod (FIG. 7*a*) to obtain a given compression ratio when the piston is at the top dead center. In order to check the accuracy of the measured pitch (lead) relative to the pitch determined by the computer, the latter takes into account the intensity of the signal received by the reading area 144. In the case of FIG. 7*a*, this signal is at its highest when the emission point 148 of indicator 140 is substantially in the middle of the thickness E of this reading area and corresponds to a maximum compression ratio. Thus, the compression ratio values can be controlled taking into account the position of the emission point 148 of indicator 140 relative to the middle of the thickness E of this reading area. Hence, one of the closed circuits 78*a*, 78*b* will be operational so that the slide 54 moves to allow angular play of eccentric 42 enabling such a position of the emission point 148 to be obtained. As soon as this angular lead is reached, the piston leaves its top dead center and proceeds to its bottom dead center (FIGS. 7*b* and 7*c*) and indicator 140 moves away from the center zone of area 144 (FIG. 7*b*) and eventually arrives in the vicinity of the bottom dead center, at a distance from reader 142 (FIG. 7*c*). Likewise, this computer determines the angular lead Ci (FIG. 7*d*) of the eccentric relative to the lengthwise axis of the compression ratio, when the piston is at the bottom dead center, to obtain a nominal compression ratio or to reduce the compression ratio obtained in a previous phase. To arrive at this determination, this computer takes into account the intensity of the signal received by the reading area 146 and, as mentioned above, this signal is at its highest value when the emission point of indicator 140 is substantially in the center of the thickness E of this region. Hence, circuits 78*a*, 78*b* will be actuated such that the slide can allow angular play of the eccentric enabling such an angular lead to be obtained.

According to one variant, the reader 142 has conducting wires, insulated from each other and disposed essentially radially relative to its arcuate shape over its thickness E. These conducting wires constitute a plurality of receivers of the signals emitted by indicator 140, distributed angularly from the upper part of reader 142 to its lower part. Indicator 140 describes, for each rotation of the crankshaft, a substantially circular curve with a radius less than the radius of the substantially circular shape of the reader 142. The substantially circular curve described by indicator 140 moves translationally as a function of the angular lead of eccentric 42. This translational movement, the radius of reader 142, and its position are such that the indicator 140 comes opposite the conducting wires in the thickness E of the reader 142 in an arc of a circle whose position is characteristic of the angular lead of eccentric 42. Hence, knowledge of the identity of the conducting wires in the thickness E of the reader reported by indicator 140 during rotation of the crankshaft provides the angular position of the eccentric with an accuracy that depends on the pitch of the conducting wires.

According to another variant, the accuracy of the reading of the angular lead of eccentric 42 is improved by conjugated reading of the position and intensity of the signals received by the conducting wires informed by indicator 140 during rotation of the crankshaft. When the indicator 140 is right opposite the thickness E of the reader 142, for example in FIGS. 7*a* and 7*d*, at least one of the conducting wires receives a maximum information signal from indicator 140. When indicator 140 is partially opposite the thickness E of reader 142, for example for FIG. 7*b*, the informed wires receive a weaker signal from indicator 140.

Advantageously, the compression ratio can be gradually and continuously decreased by increasing the angular lead from C to Ci and conversely by increasing from Ci to C, and doing so engine combustion cycle by engine combustion cycle.

Of course, the present invention is not confined to the embodiments described but encompasses all variants and equivalents.

In particular, the compression ratio varying device can be placed at the foot of connecting rod 26 with an eccentric mounted on the shaft 24 of piston 14.

The invention claimed is:

1. A device for varying compression ratio of an internal combustion engine having at least one cylinder including a combustion chamber, a piston translationally movable under action of a connecting rod that is connected by a shaft to the piston and connected to a crankpin of a crankshaft, the piston travelling between top dead center and bottom dead center which provides a dead volume at the top dead center of the piston, a rotary pull eccentric slidably disposed between the crankpin and the connecting rod for varying the compression ratio and means for controlling the movement of the eccentric, wherein the control means includes a hydraulic cylinder comprising a slide in a recess in a support and including fluid chambers in communication with at least one closed circuit, the closed circuit including at least one valve for controlling a flowrate of fluid from one chamber to another chamber, and the at least one valve comprises a piezoelectric device.

2. A device for varying the compression ratio according to claim 1, wherein the fluid chambers are in communication with each other via at least one closed circuit.

3. A device for varying the compression ratio according to claim 1, wherein the at least one valve is an at least a two-way valve.

4. A device for varying the compression ratio according to claim 1, wherein the piezoelectric device includes a needle valve and a piezoelectric actuator.

5. A device for varying the compression ratio according to claim 1, wherein the piezoelectric device is controlled by cooperation of contacts and electrical segments.

6. A device for varying the compression ratio according to claim 1, wherein the at least one closed circuit is at least partly in the hydraulic cylinder.

7. A device for varying the compression ratio according to claim 1, wherein the eccentric includes means for locating a position of the rotary pull eccentric.

8. A device for varying the compression ratio according to claim 7, wherein the means for locating comprises a signal transmitter-receiver assembly.

9. A device for varying the compression ratio according to claim 8, wherein the eccentric includes the transmitter and the receiver is in a fixed part of the engine.

10. A device for varying the compression ratio according to claim 1, wherein the eccentric includes means for engaging the slide.

11. A device for varying the compression ratio according to claim 10, wherein the means for engaging includes a toothed sector mounted on the eccentric and a toothed rack mounted on the slide.

12. A device for varying compression ratio of an internal combustion engine having at least one cylinder including a combustion chamber, a piston translationally movable under action of a connecting rod that is connected by a shaft to the piston and connected to a crankpin of a crankshaft, the piston travelling between top dead center and bottom dead center which provides a volume at the top dead center of the piston, a rotary pull eccentric slidably disposed between the crankpin and the connecting rod for varying the compression ratio and means for controlling the movement of the eccentric, wherein the control means includes a hydraulic cylinder comprising a slide in a recess in a support and including fluid chambers in communication with at least one closed circuit, the closed circuit including at least one valve and at least one metering device located downstream of the at least one valve.

13. A device for varying the compression ratio according to claim 12, wherein the at least one metering device includes a piston-cylinder assembly including a calibrating spring.

14. A method for varying the compression ratio of an internal combustion engine, having at least one cylinder including a combustion chamber, a piston translationally movable under action of a connecting rod that is connected by a shaft to the piston and connected to a crankpin of a crankshaft, the piston travelling between top dead center and bottom dead center which provides a dead volume at the top dead center of the piston, a rotary pull eccentric slidably disposed between the crankpin and the connecting rod for varying the compression ratio and means for controlling the movement of the eccentric, wherein the control means includes a hydraulic cylinder comprising a slide in a recess in a support and including fluid chambers in communication with at least one closed circuit, the closed circuit including at least one valve for controlling a flowrate of fluid from one chamber to another chamber, and the at least one valve comprises a piezoelectric device, comprising:

determining a desired compression ratio of the engine;

determining a displacement of the rotary pull eccentric to obtain the desired compression ratio; and controlling rotation of the eccentric to obtain the determined displacement by controlling the hydraulic cylinder to command the displacement of the eccentric.

* * * * *